US007695213B1

(12) United States Patent
Akkala et al.

(10) Patent No.: US 7,695,213 B1
(45) Date of Patent: Apr. 13, 2010

(54) CAM-LIFT FOR A MANHOLE COVER

(75) Inventors: Steven M. Akkala, Neenah, WI (US); Randy P. Remme, Fremont, WI (US)

(73) Assignee: Neenah Foundry Company, Neenah, WI (US)

( * ) Notice: Subject to any disclaimer, the term of this patent is extended or adjusted under 35 U.S.C. 154(b) by 0 days.

(21) Appl. No.: 12/332,952

(22) Filed: Dec. 11, 2008

Related U.S. Application Data

(60) Provisional application No. 61/013,181, filed on Dec. 12, 2007.

(51) Int. Cl.
*E06B 11/00* (2006.01)

(52) U.S. Cl. ..... 404/25; 52/19; 49/33

(58) Field of Classification Search ..... 404/25, 404/26; 49/33, 49; 52/19, 20
See application file for complete search history.

(56) References Cited

U.S. PATENT DOCUMENTS 1,225,679 A * 5/1917 Ransehousen ..... 220/210
1,314,306 A * 8/1919 Cullison ..... 220/86.2
1,399,759 A * 12/1921 Fulenwider ..... 220/291
1,599,509 A * 9/1926 Bemis, Sr. ..... 49/465
2,295,909 A * 9/1942 Massey ..... 248/147
3,262,227 A * 7/1966 Pentecost ..... 49/354
3,841,518 A * 10/1974 Hines ..... 220/326
4,042,148 A * 8/1977 Gerben ..... 221/222
4,279,356 A * 7/1981 Amorese et al. ..... 220/314
5,295,535 A * 3/1994 Boles et al. ..... 166/81.1
5,531,541 A * 7/1996 Clover et al. ..... 404/25
5,788,406 A * 8/1998 Hernandez ..... 404/25
6,446,307 B2 * 9/2002 Wilkins ..... 16/325
7,341,398 B2 * 3/2008 Johnson et al. ..... 404/25

* cited by examiner

*Primary Examiner*—Raymond W Addie
(74) *Attorney, Agent, or Firm*—Krieg DeVault LLP

(57) ABSTRACT

A manhole cover assembly including a frame defining an opening and a cover sized to engage the opening. A lift pin is retained by the frame, defining a first axis, and includes a bearing portion, and a top end connected to the cover. The lift pin is free to slide axially along the first axis. A spiral cam is retained to the frame by a torque shaft including an upper and lower end, defining a second axis offset from the first axis. The spiral cam includes a cam surface in selective engagement with the bearing portion of the lift pin so that rotation of the torque shaft about the second axis causes rotation of the spiral cam about the second axis and displacement of the lift pin along the first axis.

15 Claims, 7 Drawing Sheets

FIG. 4
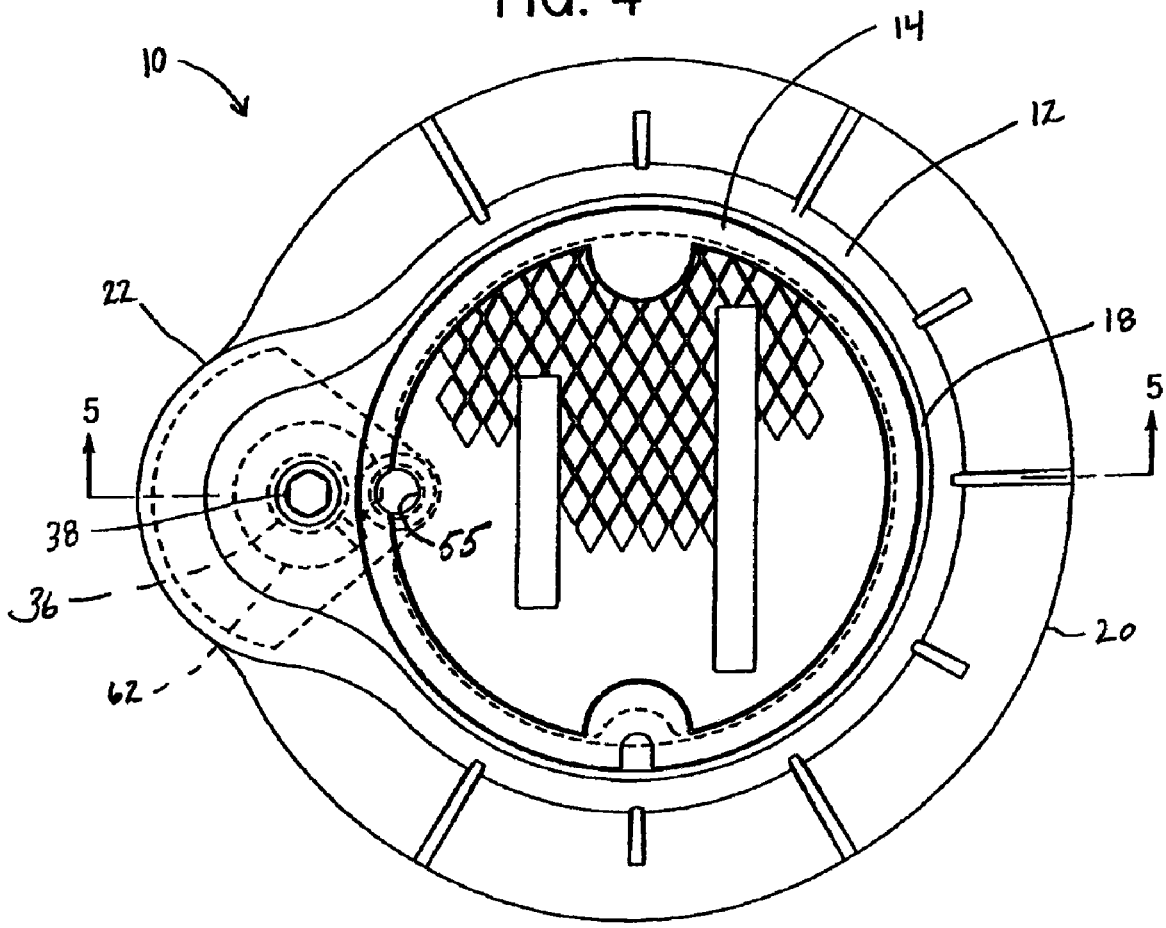
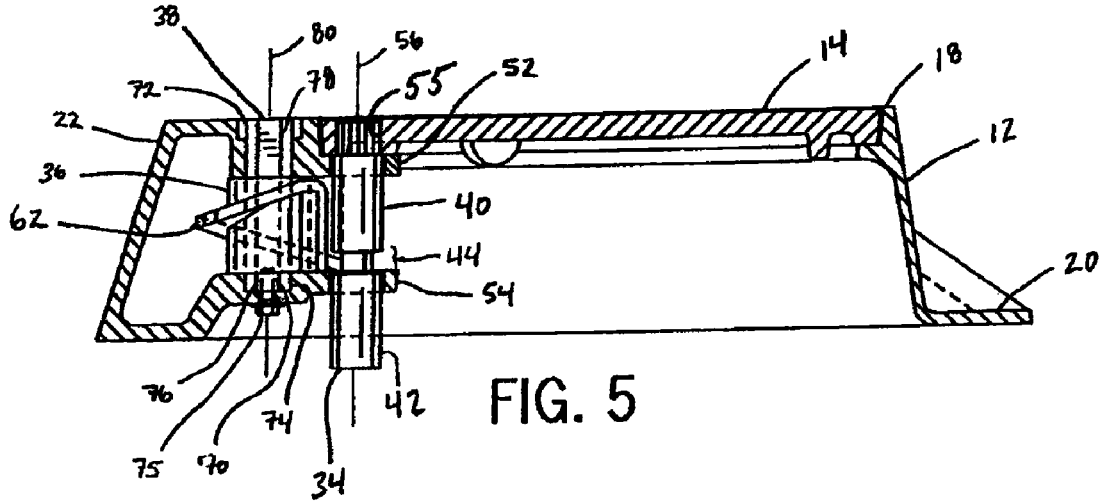
FIG. 5

CAM-LIFT FOR A MANHOLE COVER

CROSS-REFERENCE TO RELATED APPLICATION

This claims the benefit of U.S. Provisional Patent Application No. 61/013,181 filed Dec. 12, 2007.

STATEMENT CONCERNING FEDERALLY SPONSORED RESEARCH OR DEVELOPMENT

Not applicable.

FIELD OF THE INVENTION

The present invention relates to a manhole cover assembly and more particularly a cam-lift for use in a manhole cover.

BACKGROUND OF THE INVENTION

Underground passages are prevalent in developed areas and provide passageways for everything from fiber optic data lines, to sewage, to electrical power transmission lines. Workers require access to the underground passageways to perform routine maintenance and to correct defects that may occur to the utility passing within. Thus, the manhole cover was created to close off the passageways and still provide a means of ingress and egress to the passageways.

A manhole cover must be durable, strong, and relatively inexpensive. Durability is required as many cover applications are exposed to the environment and associated climatic conditions. Strength is desired because many applications place the manhole cover into high traffic situations where the cover is required to repeatedly support a large amount of weight, for example, a passing garbage truck on a city street. Cost is a driving force behind most all cover designs and inexpensive manhole covers are preferred, especially given the volume of manhole cover applications. As a result, the type of materials used as well as the type and amount of secondary manufacturing operations employed in the design and production of manhole covers is limited.

Manhole covers come in various shapes and sizes. Manhole covers may be circular or any other shape that prevents a worker from dropping the cover into the manhole it was designed to cover. Covers range in size depending upon the application and can be very heavy. Most manhole covers are big enough to permit human passage, perhaps a meter or more across. Furthermore, due to the durability, strength, cost, and application requirements discussed above, manhole covers are typically cast iron and weigh between thirty to over one-hundred and thirty kilograms.

The size and weight of many manhole covers combine to create a heavy, awkward cover and give rise to several potential hazards and problems. Workers having to remove and lift larger covers are susceptible to accidental injuries should the cover slip and land upon a hand, leg, foot, or other body part. Repeated lifting of heavy covers may lead to chronic physical ailments requiring painful and expensive rehabilitation. The demanding physical requirements imposed by the size and weight of some covers limits the pool of workers capable of individually manipulating a cover. In turn, this requires that more than one worker be deployed to accomplish a task that, but for the manipulation of a manhole cover, could be accomplished by a single worker.

Attempts have been made to reduce the stresses placed on a worker in manipulating a manhole cover while meeting the durability, strength, and cost requirements of each application; however, room still exists for improvement.

SUMMARY OF THE INVENTION

The present invention addresses the hazards and problems associated with manipulating current manhole cover assemblies. In particular, the present invention includes an assembly for conveniently raising a cover from an opening, rotating a cover away from and back over an opening, and lowering a cover back onto an opening. The cover can be raised, rotated, and lowered with minimal force and effort by a single worker using the present invention.

The present invention, in one embodiment, includes a frame defining an opening and a cover sized to engage the opening. A lift pin is retained by the frame, defining a first axis, and includes a bearing portion, and a top end connected to the cover. The lift pin is free to rotate about and slide axially along the first axis. A spiral cam is retained to the frame by a torque shaft including an upper and lower end, defining a second axis offset from the first axis. The spiral cam includes a cam surface in selective communication with the bearing portion of the lift pin so that rotation of the torque shaft about the second axis causes rotation of the spiral cam about the second axis and displacement of the lift pin along the first axis.

The foregoing and other objects and advantages of the invention will be apparent from the following description. In the description, reference is made to the accompanying drawings that form a part hereof and in which there is shown, by way of illustration, preferred embodiments of the invention. These embodiments, however, do not necessarily represent the full scope of the invention and reference must be made to the claims for determining the scope of the invention.

BRIEF DESCRIPTION OF THE DRAWINGS

FIG. 4 is a top view of an embodiment of the present invention in the closed position;

FIG. 5 is a partial cross-sectional view along line 5-5 of FIG. 4;

DETAILED DESCRIPTION OF THE PREFERRED EMBODIMENT

Figure 1:
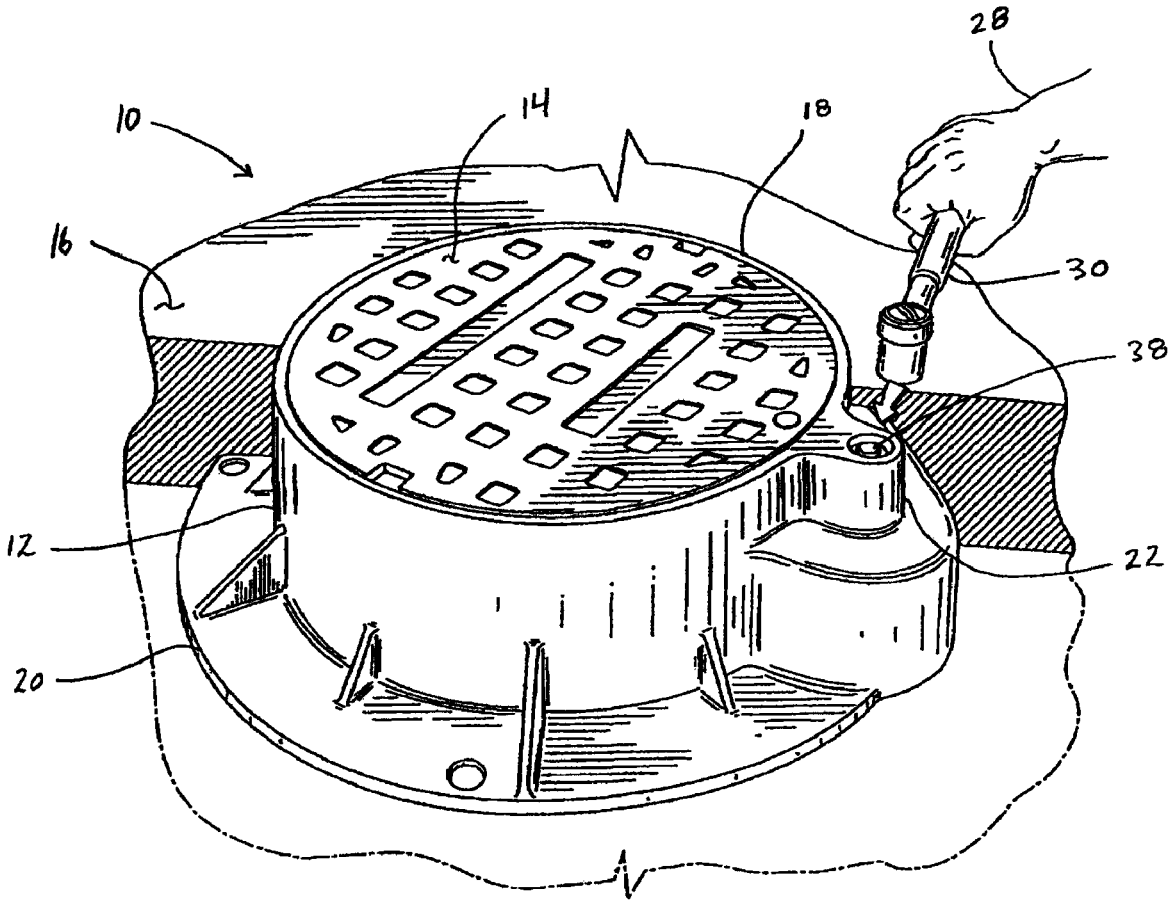
FIG. 1 is a fragmentary perspective view of an embodiment of the present invention in the lowered position.

A manhole cover assembly is generally designated by reference number 10, as shown in FIG. 1. The manhole cover assembly includes a frame 12 and a cover 14. A half round housing 22 of the frame 12 houses a cam-lift assembly 26, in accordance with the present invention, for raising, rotating, and lowering the cover 14 (described in detail below and shown in FIG. 2). The frame 12 is typically manufactured from gray cast iron, but may be made of any suitable material, such as steel, aluminum, or plastic, provided the material is capable of meeting the application requirements. As shown in FIGS. 1 and 3, the frame 12 is usually recessed below an application surface 16 (e.g., roadway, sidewalk, and the like) so that an upper rim 18 of the frame 12 is flush with the application surface 16. The frame 12 of the preferred embodiment is circular (as viewed from above as shown in FIG. 1); however, the frame 12 may be any suitable shape, such as square, rectangular, octagonal, and the like. The frame 12 includes a lower flange 20 that is typically mated to a passageway (not shown).

The cover 14 is sized to engage the frame 12, specifically an inner lip 24 formed within the frame 12. Thus, the cover 14 may take any appropriate shape to accommodate and seat to the frame 12. The cover 14 is also commonly of gray cast iron, but may be of any suitable material. With the overall manhole cover assembly 10 described, the general operation of the manhole cover assembly 10 and cam-lift assembly 26 will be discussed in greater detail.

Starting from the position shown in FIG. 1, the cover 14 can be raised (shown in FIG. 6), rotated (shown in FIGS. 3, 7, and 8), and lowered (shown in FIGS. 1, 4, and 5) through the aid of the cam-lift assembly 26. The raising and lowering of the cover 14 is controlled by the direction a worker 28 rotates a tool 30 (shown as a ratchet in FIG. 1) while engaging the cam-lift assembly 26. In the preferred embodiment, clockwise rotation (as viewed from above in FIG. 1) will cause the cover 14 to rise, while counterclockwise rotation will cause the cover 14 to lower onto the frame 12. In general, rotation of a torque shaft 38 rotates a spiral cam 36 that urges a lift pin 34, and thus the cover 14, in the desired direction. When the cover 14 is in the raised position (shown in FIG. 6) it can be rotated away from the opening 32 (shown in FIGS. 3, 7, and 8). A more detailed explanation of the cam-lift assembly 26 operation is presented after the individual components and their assembly is described.

Figure 11:
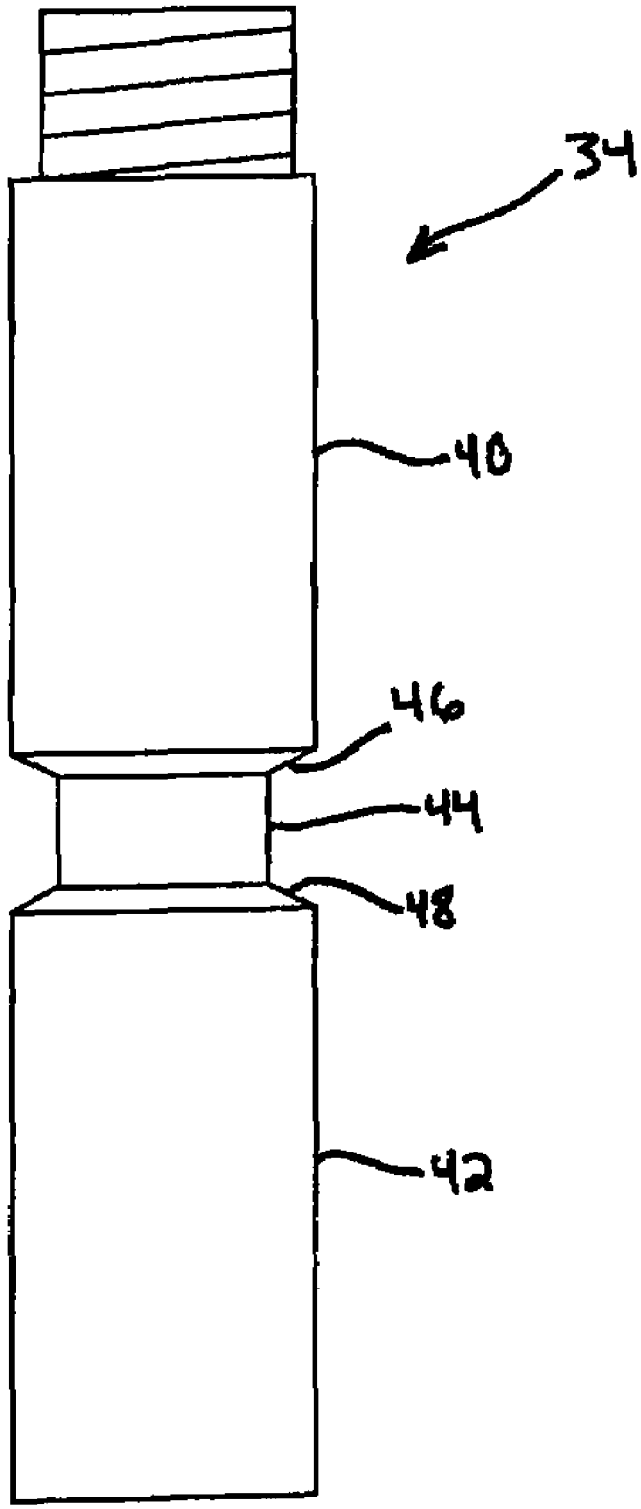
FIG. 11 is a side view of an alternative lift pin.

The structure and operation of the cam-lift assembly 26 will be discussed with reference to FIG. 2. The cam-lift assembly 26 includes a lift pin 34, a spiral cam 36, and a torque shaft 38 (not visible in FIG. 2). In the preferred embodiment, the lift pin 34 is a cylindrical rod including an upper portion 40 and a lower portion 42 that are separated by a bearing portion 41 having an annular groove forming a recessed portion 44. The recessed portion 44 forms an upper shoulder 46 and a lower shoulder 48. The upper shoulder 46 and the lower shoulder 48 may be tapered, as shown in FIG. 11. A segment of the upper portion 40 may be threaded to engage a mating threaded recess in the cover 14 so that movement of the lift pin 34 results in similar movement of the cover 14. Many other connections between the lift pin 34 and cover 14 are possible and known to those skilled in the art. For example, the lift pin 34 may be formed integrally with the cover 14 and remain within the scope of the present invention. Preferably, the lift pin 34 is machined from high strength steel to accommodate the large moment created when the cover 14 is raised and cantilevered to the lift pin 34. The lift pin 34 may also be cast, manufactured from powder metal, or any other suitable material.

To facilitate raising, rotating, and lowering of the cover 14, the lift pin 34 is slideably and rotatably engaged with the frame 12 via coaxial lift pin holes 50 formed in a top flange 52 and a bottom flange 54. The lift pin holes 50 define a first axis 56. The top flange 52 and bottom flange 54 are offset parallel flanges extending from the frame 12 towards the center of the manhole cover assembly 10. The top flange 52 is integral with the inner lip 24 of the frame 12. The bottom flange 54 extends inward from the housing 22 and defines an interior land 58 supporting the spiral cam 36 (discussed in detail below). The flanges 52, 54 are preferably cast as part of the frame 12 and may be made from the same materials as described above in relation to the frame 12. Other equivalent structures to the flanges 52, 54 may be used by one skilled in the art; for example, a separate bracket may be inserted into the frame 12 to retain the lift pin 34 and support the spiral cam 36.

Figure 2:
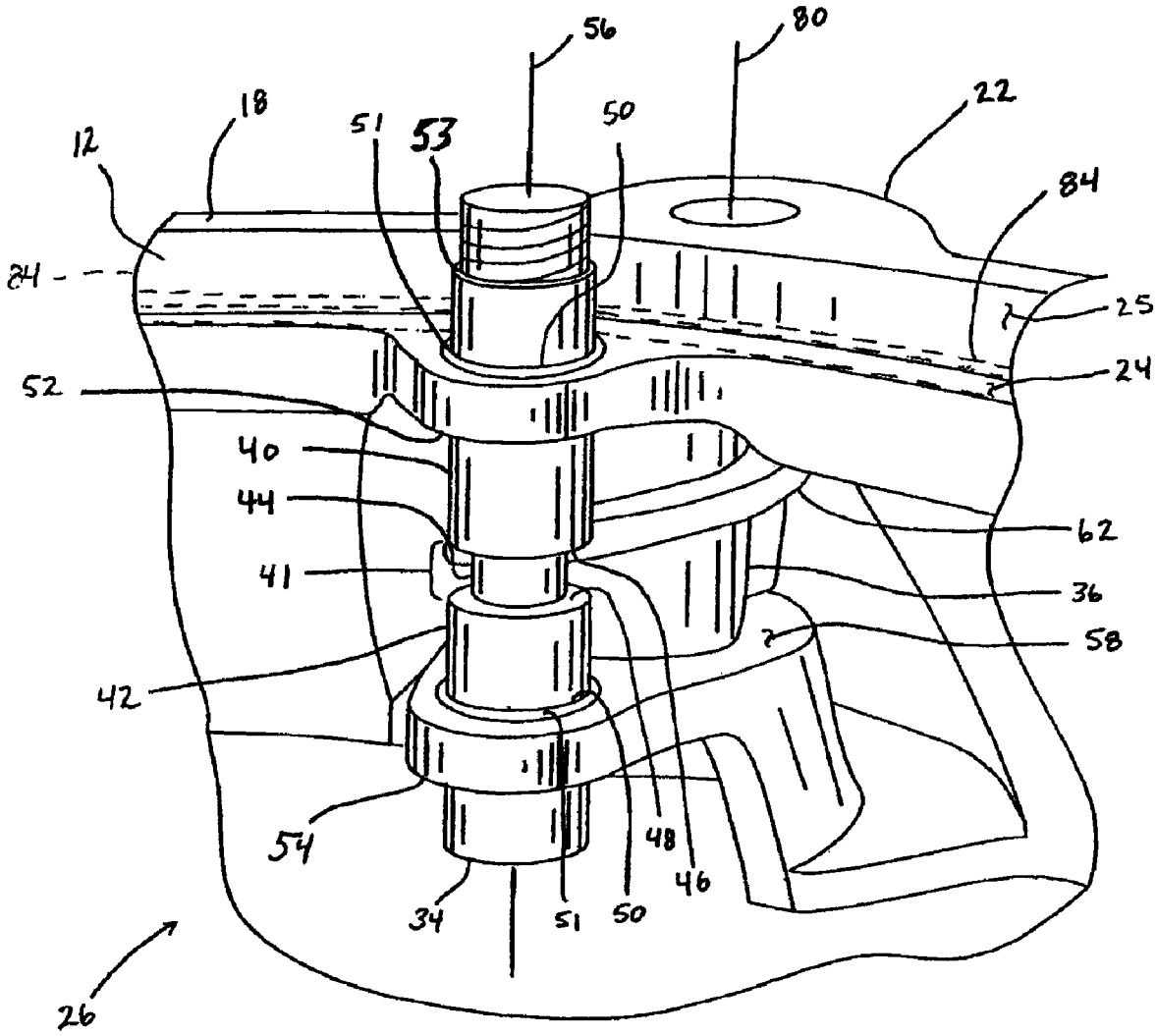
FIG. 2 is a fragmentary detail perspective view of a portion of the embodiment of FIG. 1.
Figure 3:
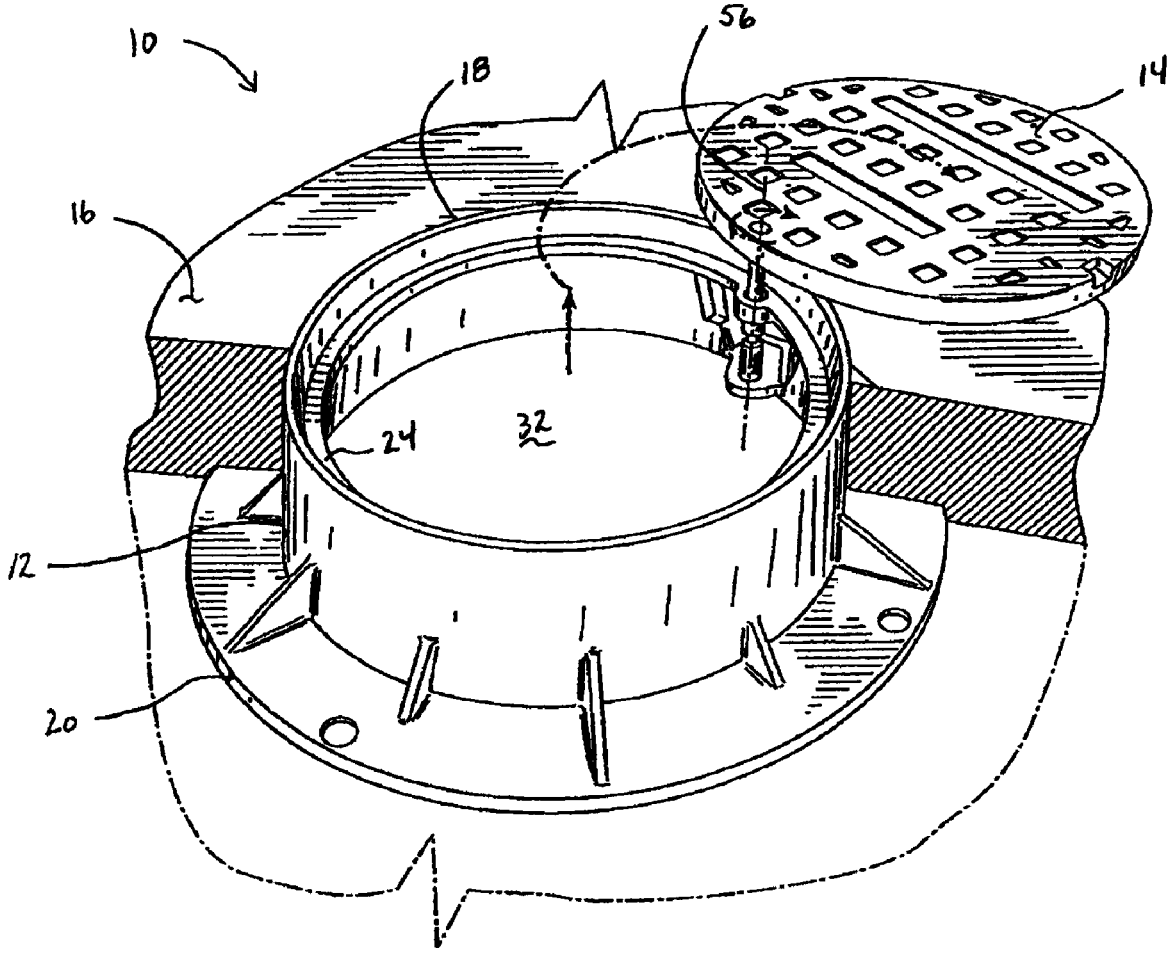
FIG. 3 is a view like FIG. 1 but with the cover lifted and rotated open.
Figure 9:
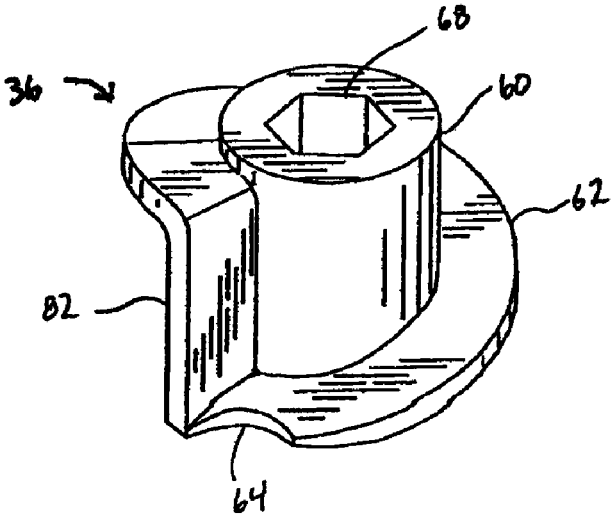
FIG. 9 is a perspective view of a cam of the assembly.
Figure 10:
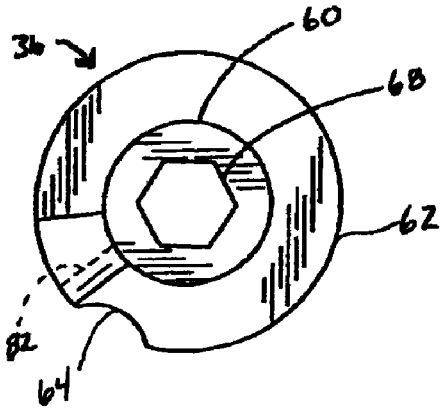
FIG. 10 is a top view of the cam of FIG. 9.

With reference to FIGS. 2, 9, and 10, a preferred embodiment of the spiral cam 36 is disclosed. The spiral cam 36 is rotated to engage the lift pin 34 to raise and lower the cover 14. In the preferred embodiment, the spiral cam 36 has a center cylindrical body 60 with a cam surface 62 protruding therefrom that spirals about the center cylindrical body 60. The cam surface 62 has a rectangular cross-section and increases linearly up the center cylindrical body 60 from a lowest point to a highest point within one revolution of the cylindrical body 60. While the preferred embodiment includes a linearly increasing cam surface 62, the cam surface 62 may increase at a non-linear rate and be within the scope of the present invention. Furthermore, the cam surface 62 may spiral about the center cylindrical body 60 multiple times before reaching the top—this may be of use where the cover 14 is of substantial weight and an increased mechanical advantage is required for ease of lifting, or where space limitations prevent the worker 28 from using a tool 30 having a sufficient mechanical advantage. The cam surface 62 need not have a rectangular cross-section and may be of a circular cross-section, triangular cross-section, and the like.

Additionally, the preferred embodiment includes a notch 64 formed in the lowest portion of the cam surface 62, providing clearance for the lift pin 34 to be inserted past the spiral cam 36, as will be described below. A hexagonal hole 68 extends through the center cylindrical body 60 of the spiral cam 36 and is sized to engage the torque shaft 38 that is also engageable with a wrench 30 by a worker 28 (described below). The hole 68, or at least the top of the shaft 38, may be of various shapes, for example, if security of the manhole cover assembly 10 is of greater importance, a specialized shape can be made that is matched to a specialized tool used to rotate the mating torque shaft 38. The shape may be, for example, a square, triangle, and the like. The spiral cam 36 is preferably made of gray cast iron but may be made of other types of metals and may be machined in lieu of cast.

The torque shaft 38, shown in FIGS. 1, 5, 6, and 8, provides the interface where the worker 28 can raise or lower the cover 14 with the tool 30. Referring to FIGS. 4 and 5, the torque shaft 38 of the preferred embodiment is a hexagonal rod having a threaded hole 70 formed in a lower end 76 thereof for receiving a fastener 75. The torque shaft 38 also has an upper end 78 for engaging a tool 30 (shown in FIG. 1). As with the hole 68 of the spiral cam 36, the cross-section of the torque shaft 38 may be any of many shapes, just so turning the shaft 38 turns the cam 36. The interaction and operation of the torque shaft 38 is discussed in greater detail below.

The assembly of the cam-lift assembly 26 is accomplished as follows, with reference to FIGS. 2 and 5. First, the spiral cam 36 is inserted into the housing 22 and placed on the interior land 58 (shown in FIG. 2). The hexagonal hole 68 (shown in FIGS. 9 and 10) of the spiral cam 36 is aligned with a second circular blind hole 74 formed in the interior land 58 of the bottom flange 54. The torque shaft 38 is then inserted into the frame 12 through a first circular hole 72 formed in the housing 22 that fits closely with the hex shaft 38 but allows turning, like the hole 74 does. The torque shaft 38 is inserted into the mating hexagonal hole 68 of the spiral cam 36 until the lower end 76 engages the second hole 74. The assembly of the spiral cam 36 and torque shaft 38 through the first and second holes 72, 74 define a second axis 80 offset from the first axis 56. The torque shaft 38 and spiral cam 36 are thus connected and rotate in concert. To encapsulate the spiral cam 36 between the frame 12 and the interior land 58, the fastener 75 is inserted beneath the interior land 58, through a hole in the bottom wall of the hole 74 and into the threaded hole 70 in the lower end 76 of the torque shaft 38. The torque shaft 38 and spiral cam 36 are still free to rotate in the holes 72, 74 about the second axis 80. The upper end 78 of the torque shaft 38 extends into the first hole 72, preferably flush with the upper or traffic-bearing surface of the manhole, to allow a tool 30 (shown in FIG. 1) to engage the upper end 78 and rotate the cam 36.

Next, the upper portion 40 of the lift pin 34 is preferably connected to the cover 14. The connection of the preferred embodiment calls for an upper portion 40 to extend through a slightly larger hole 55 in the cover 14 and may be secured therein by a nut received in a counterbore of the hole 55 in the cover 14. Alternatively, the pin 34 could be pressed in, welded, brazed, formed integrally, or otherwise suitably connected to the cover 14. The upper portion 40 has a shoulder 53 on which the cover 14 rests, and the portion 40 may be threaded if it is to be secured by a nut, or not.

The notch 64 (shown in FIGS. 9 and 10) in the spiral cam 36 is then aligned with the lift pin holes 50. The notch 64 provides clearance for the lower portion 42 of the lift pin 34 to pass by the cam surface 62. The lift pin 34 is then aligned with the lift pin holes 50 along the first axis 56 and inserted approximately until the bearing portion 41 of the lift pin 34 is flush with the bottom flange 54 and notch 64. The pin 34 is preferably attached to the cover 14 when this is done so it cannot drop all of the way through the holes 50. Metallic or plastic bushings 51 are preferably seated in the lift pin holes 50 to aid the rotation and axial sliding of the lift pin 34. The torque shaft 38 is then rotated clockwise to engage the cam surface 62 with the bearing portion 41 of the lift pin 34, which also holds the lift pin 34 axially.

Figure 6:
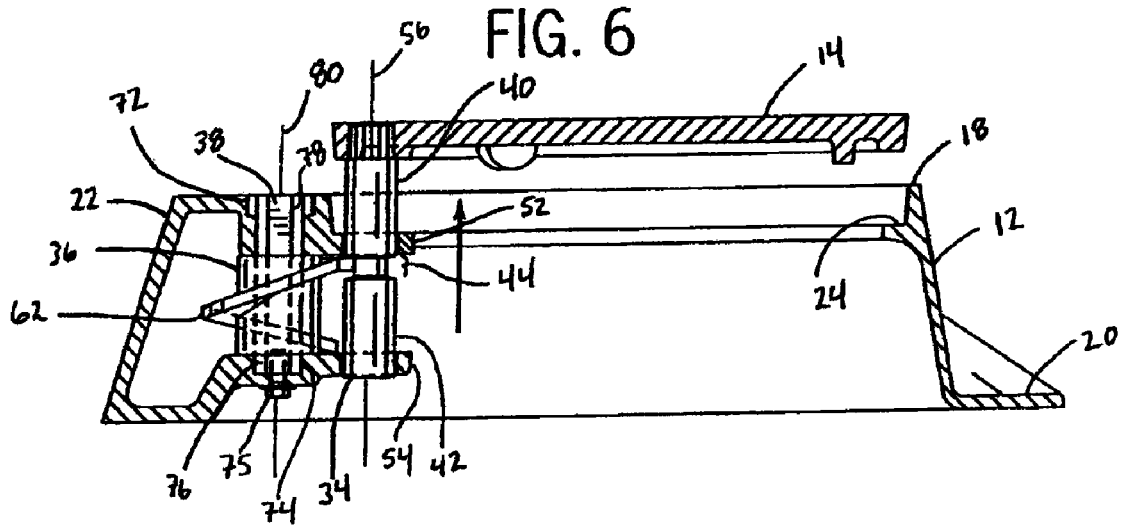
FIG. 6 is a view like FIG. 5 but with the cover raised.

At this point, the vertical displacement (i.e., raising and lowering) of the lift pin 34 and connected cover 14 is controlled by the rotation of the torque shaft 38 and connected spiral cam 36. As shown in FIG. 2, as the torque shaft 38 is rotated clockwise by the tool 30, the spiral cam 36 rotates clockwise and the cam surface 62 cams against the upper shoulder 46 of the recessed portion 44 of the lift pin 34 causing a vertical displacement of the lift pin 34 to raise the connected cover 14. FIG. 6 shows the cover 14 in the raised position where the cam surface 62 has raised the bearing portion 41 of the lift pin 34 to approximately the top flange 52 of the frame 12. The cover 14 need only be raised to provide sufficient rotational clearance from the frame 12 so it can be rotated from being over the opening into the manhole. A stop tab 82 (shown in FIGS. 9 and 10) prevents over-rotation of the spiral cam 36. The stop tab 82 may be located at any location of the spiral cam 36 to restrict the rotation of the spiral cam 36 given the application requirements.

Figure 8:
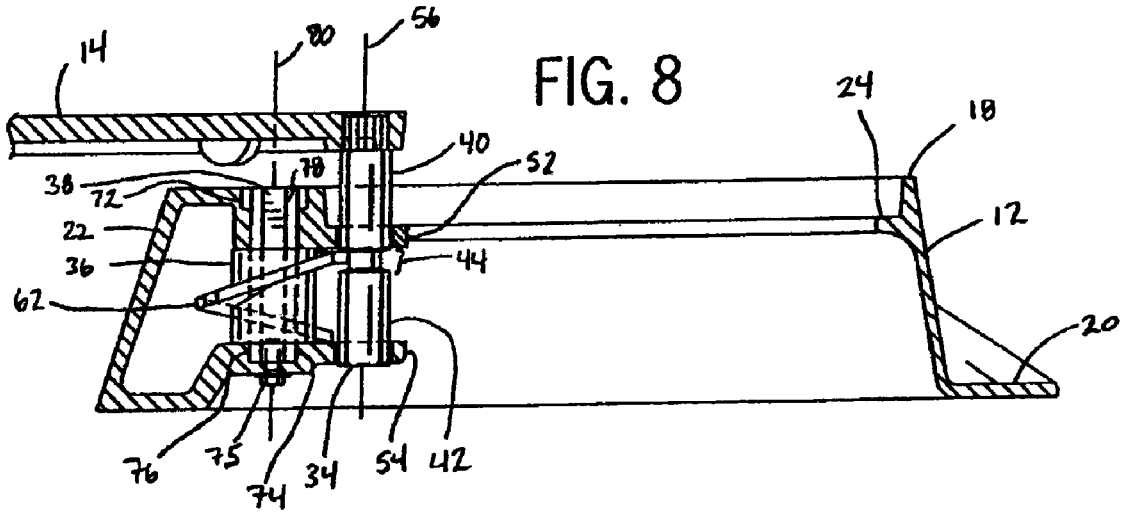
FIG. 8 is a view like FIG. 6 but with the cover rotated to the open position.
Figure 7:
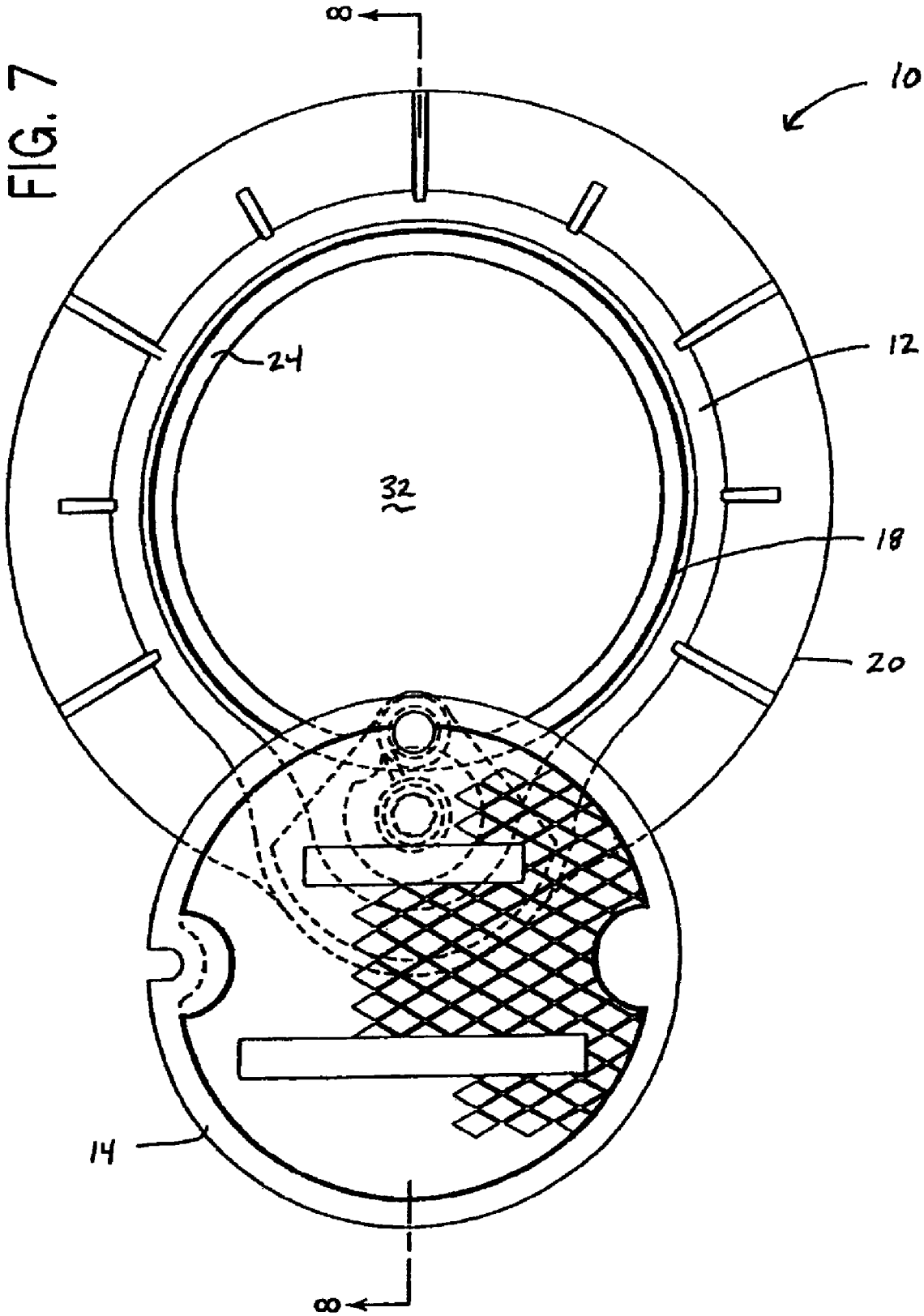
FIG. 7 is a view like FIG. 4 but with the cover in the raised and rotated open position.

In the raised position, the cover 14 is capable of rotation about the first axis 56 (shown in FIGS. 3, 7, and 8). As the cover 14 rotates, the lift pin 34 may rotate accordingly and independently of the spiral cam 36, particularly if it is fixed to the cover 14. As shown in FIGS. 7 and 8, the cover 14 is capable of being rotated away from the opening 32 to allow sufficient access to the opening 32.

To lower the cover 14 onto the opening 32, the cover 14 is rotated into alignment with the opening 32 and the torque shaft 38 is rotated in the counterclockwise direction. Preferably, the bearing portion 41 of the lift pin 34 includes a lower shoulder 48 that cams along the cam surface 62 when the spiral cam 36 is rotated in the counterclockwise direction to help lower the cover 14 if necessary. However, this is usually not necessary since gravity is normally sufficient to lower the cover 14, depending upon the alignment of the lift pin 34 and lift pin holes 50 along the first axis 56, the fit of the bushings 51 against the upper portion 40 and lower portion 42 of the lift pin 34 and the weight of the cover 14. This configuration also allows for a rubber or plastic gasket 84 (shown only in FIG. 2 in phantom) to be included to prevent unwanted interaction between the cover 14, inner lip 24, and vertical wall 25 of the frame 12 (e.g., a rattling cover as a vehicle passes across).

A preferred embodiment of the present invention has been described in considerable detail. Many modifications and variations of the preferred embodiment described will be apparent to a person of ordinary skill in the art. Therefore, the invention should not be limited to the embodiments described.

We claim:

1. A manhole cover assembly, comprising:

a frame defining an opening;

a cover sized to substantially cover the opening;

a lift pin mounted to the frame, the lift pin defining a first axis and including a bearing portion, the lift pin supporting the cover in an elevated position of the lift pin and being free to slide axially along the first axis relative to the frame;

a torque shaft journalled by the frame and defining a second axis offset from the first axis;

a spiral cam in rotary engagement with the torque shaft and including a cam surface in engagement with the bearing portion of the lift pin so that rotation of the torque shaft about the second axis causes rotation of the spiral cam about the second axis and displacement of the lift pin along the first axis.

2. The manhole cover assembly of claim 1, wherein:

the frame includes a top flange and a bottom flange; and wherein a pair of lift pin holes are formed through the top and bottom flanges coaxial with the first axis.

3. The manhole cover assembly of claim 2, wherein at least one bushing is retained in the lift pin holes.

4. The manhole cover assembly of claim 2, wherein:

the frame includes a housing; and wherein a first hole sized to receive the torque shaft is formed through the housing coaxial with the second axis.

5. The manhole cover assembly of claim 4, wherein:

the frame includes an interior land;

a second hole is formed through the interior land coaxial with the second axis to receive a lower end of the torque shaft; and wherein a fastener engages the bottom end of the torque shaft, whereby the interior land is captured between the fastener and the torque shaft.

6. The manhole cover assembly of claim 1, wherein the lift pin is fixed to the cover and the cover and lift pin are rotatable relative to the frame about the first axis.

7. The manhole cover assembly of claim 1, wherein the bearing portion of the lift pin includes a recessed portion that bears on the cam surface.

8. The manhole cover assembly of claim 7, wherein the cam surface of the spiral cam protrudes from the torque shaft.

9. The manhole cover assembly of claim 1, wherein the torque shaft includes a bottom end having a threaded hole for receiving a fastener through an interior land defined by said frame.

10. The manhole cover assembly of claim 1, wherein the spiral cam includes a polygonal opening therethrough sized to receive the torque shaft.

11. The manhole cover assembly of claim 1, wherein the spiral cam includes a hexagonal opening therethrough sized to mate in driving engagement with the torque shaft.

12. The manhole cover assembly of claim 1, wherein the torque shaft has a hexagonal cross-section.

13. The manhole cover assembly of claim 1, wherein the cam surface of the spiral cam includes a notch sized to provide clearance for the lift pin when the spiral cam is in a predetermined orientation relative to the lift pin.

14. The manhole cover assembly of claim 1, wherein the spiral cam includes a stop to limit the rotation of the spiral cam.

15. A method of uncovering a manhole frame, comprising:

engaging a wrench with a torque shaft journalled in the frame, the torque shaft being journalled in the frame along a generally vertical torque shaft axis;

turning the torque shaft with the wrench so as to turn a cam surface that is turned by turning the torque shaft about the torque shaft axis;

camming the cam surface along a surface of a lift pin by continuing to turn the torque shaft, resulting in lifting of the lift pin along a generally vertical lift pin axis that is laterally offset from the torque shaft axis;

the lift pin being connected to a cover sized to substantially cover an opening of the manhole frame so that lifting the lift pin lifts the cover; and turning the cover about the lift pin so as to uncover the manhole frame.

* * * * *